US007162946B2

(12) United States Patent
Jeon

(10) Patent No.: US 7,162,946 B2
(45) Date of Patent: Jan. 16, 2007

(54) HYDRAULIC CONTROL VALVE HAVING HOLDING VALVE WITH IMPROVED RESPONSE CHARACTERISTICS

(75) Inventor: Man Suk Jeon, Kyungsangnam-do (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 0 days.

(21) Appl. No.: 11/103,922

(22) Filed: Apr. 12, 2005

(65) Prior Publication Data

US 2005/0247188 A1 Nov. 10, 2005

(30) Foreign Application Priority Data

May 4, 2004 (KR) ..... 10-2004-0031400

(51) Int. Cl.
*F15B 13/04* (2006.01)

(52) U.S. Cl. ..... 91/445; 91/447

(58) Field of Classification Search ..... 91/445, 91/446, 447

See application file for complete search history.

(56) References Cited

U.S. PATENT DOCUMENTS 3,943,825 A * 3/1976 Bianchetta et al. ..... 91/445
4,192,346 A * 3/1980 Iizumi ..... 91/447
4,204,459 A * 5/1980 Johnson ..... 91/445
4,732,076 A 3/1988 Ewald
5,259,293 A 11/1993 Brunner
6,186,044 B1 2/2001 Hajek, Jr. et al.
6,691,510 B1 * 2/2004 Kariya et al. ..... 91/445
6,907,815 B1 * 6/2005 Kim ..... 91/445

FOREIGN PATENT DOCUMENTS

JP 2-72201 3/1990

OTHER PUBLICATIONS

Patent Abstracts of Japan of JP 2-72201 dated Mar. 12, 1990.

* cited by examiner

*Primary Examiner*—Michael Leslie
(74) *Attorney, Agent, or Firm*—Ladas & Parry LLP

(57) ABSTRACT

Disclosed is a hydraulic control valve having a holding valve with improved response characteristics. The hydraulic control valve includes a valve housing including a pump path communicating with a hydraulic pump, a tank path communicating with an oil tank, and first and second cylinder ports communicating with a hydraulic cylinder, a control spool movably provided in the valve housing, cutting the pump path off the first and second cylinder ports in a neutral state and selectively connecting the pump path and the tank path with the first and second cylinder ports while moving in left and right directions if pilot signal pressures are applied thereto, a holding valve provided between the second cylinder port and the control spool, cutting off the second cylinder port when the control spool is in a neutral state and holding load of the hydraulic cylinder so as not to cause natural drop of the hydraulic cylinder, and an actuating path for the holding valve connecting hydraulic oil of the second cylinder port to the tank path when the control spool is in a neutral state.

2 Claims, 2 Drawing Sheets

HYDRAULIC CONTROL VALVE HAVING HOLDING VALVE WITH IMPROVED RESPONSE CHARACTERISTICS

CROSS-REFERENCE TO RELATED APPLICATIONS

This application claims benefit under 35 U.S.C. § 119 from Korean Patent Application No. 2004-31400, filed on May 4, 2004, the entire content of which is incorporated herein by reference.

BACKGROUND OF THE INVENTION

1. Field of the Invention

The present invention relates to a hydraulic control valve, and more particularly to, a hydraulic control valve having a holding valve with improved response characteristics in which an actuating path for the holding valve is provided to improve response characteristics of the holding valve, thereby reducing natural drop of a hydraulic cylinder.

2. Description of the Related Art

Generally, a heavy construction equipment such as an excavator is provided with working devices such as a boom, an arm, and a bucket. The heavy construction equipment is driven by a hydraulic cylinder and performs various operations. The hydraulic cylinder is operated by hydraulic oil supplied from a hydraulic pump. A hydraulic control valve is provided between the hydraulic pump and the hydraulic cylinder to supply the hydraulic oil from the hydraulic pump to the hydraulic cylinder. The working devices are driven in such a manner that the hydraulic control valve is operated to control pressure, direction, and flow of the hydraulic oil supplied to the hydraulic cylinder as a driver manipulates a lever.

The working devices are massively manufactured to endure great load and tough working conditions. In a neutral state that the working devices are idle, some of the hydraulic oil may be leaked through a spool of the hydraulic control valve and a gap of a valve housing due to load of the massive working devices and load of freight. For this reason, the working devices may naturally be dropped. Therefore, a hydraulic system fixed to the heavy construction equipment includes a holding valve that prevents natural drop due to load in a neutral state from occurring.

FIG. 1 is a circuit diagram illustrating a related art hydraulic control valve having a holding valve, and FIG. 2 is a partially sectional view illustrating a related art hydraulic control valve having a holding valve.

A related art hydraulic control valve 100 includes a valve housing 110, a control spool 120 provided in the valve housing 110 and switched by pilot signal pressures 'a' and 'b' to control flow and direction of a hydraulic oil, and a holding valve 130. The valve housing 110 includes a pump path 111 communicating with a hydraulic pump 2, a tank path 112 communicating with an oil tank 4, and first and second cylinder ports 113 and 114 communicating with a hydraulic cylinder 3.

As shown, if the control spool 120 is in a neutral state, the hydraulic oil of the hydraulic pump 2 is ejected to the oil tank 4. The holding valve 130 includes a holding poppet 131 provided between the second cylinder port 114 and the control spool 120, and a drain valve 132 supplying or cutting the hydraulic oil to or off a rear pressure chamber 134 of the holding poppet 131. In a state that the control spool 120 is neutral, the hydraulic oil of the hydraulic cylinder 3 flows into the rear pressure chamber 134 of the holding poppet 131 through the cylinder port 114 and an orifice 133 of the holding poppet 131. Therefore, the holding poppet 131 is pressurized up and down when viewed from the drawing so that the hydraulic oil of the hydraulic cylinder 3 may not be leaked into the oil tank 4.

In this state, if the pilot signal pressures 'a' and 'b' act on pilot ports 120*a* and 120*b* at left and right sides of the control spool 120, the control spool 120 is switched to the left or right side so that the hydraulic oil of the hydraulic pump 2 may flow into the first cylinder port 113 or the second cylinder port 114 to drive the hydraulic cylinder 3.

If the control spool 120 is switched to the left side as the pilot signal pressure 'a' acts on the right pilot port 120*a* of the control spool 120, the hydraulic oil of the hydraulic pump 2 flows into the first cylinder port 113 to drive the hydraulic cylinder 3. At the same time, the pilot signal pressure 'c' acts on the drain valve 132 so that the drain valve 132 may be switched to the right side and the holding poppet 131 may be opened to eject the hydraulic oil of the hydraulic cylinder 3 to the oil tank 4.

However, in this case, if the control spool 120 is switched to the neutral state, a connecting line 115 connected to the holding poppet 131 is cut off. Thus, the connecting line 115 and the second cylinder port 114 are subject to the same pressure. At this time, since the hydraulic oil supplied from the hydraulic cylinder 3 through the opened holding poppet 131 acts on the control spool 120 through the second cylinder port 114 and the connecting line 115, the hydraulic oil may be leaked out through the control spool 120 and the valve housing 110 due to load of the hydraulic cylinder 3. Since the leakage oil is not small quantity but great quantity, it acts to cause natural drop of the working devices.

If the pressure of the connecting line 115 becomes smaller than that of the second cylinder port 114 as the hydraulic oil of the connecting line 115 leaks while the working devices are naturally dropped, the holding poppet 131 is closed to prevent the leakage oil from occurring. However, time delay occurs until the holding poppet 131 is closed after the pressure of the connecting line 115 becomes smaller than that of the second cylinder port 114. Leakage oil occurs for the time delay.

As described above, since response speed of the holding valve 130 is slow in the related art hydraulic control valve 100, the hydraulic oil supplied to the rear pressure chamber 134 has been conventionally increased by increasing a sectional area of the orifice 133 of the holding poppet 131 to avoid excessive natural drop of the hydraulic cylinder 3. However, this failed to fundamentally solve time delay of the holding valve 130. Also, if the sectional area of the orifice 133 is increased, hunting occurs when the working devices are initially operated or the rear pressure increases due to increase of the hydraulic oil in the rear pressure chamber 134, thereby causing unstable working pressure.

SUMMARY OF THE INVENTION

Accordingly, the present invention is directed to a hydraulic control valve having a holding valve with improved response characteristics that substantially obviates one or more problems due to limitations and disadvantages of the related art.

An object of the present invention is to provide a hydraulic control valve having a holding valve with improved response characteristics in which natural drop of a hydraulic cylinder is reduced by improving response characteristics of the holding valve, thereby improving stability and reliability.

Another object of the present invention is to provide a hydraulic control valve having a holding valve with improved response characteristics in which an actuating path for the holding valve is provided to reduce natural drop of a hydraulic cylinder.

To achieve these objects and other advantages and in accordance with the purpose of the invention, as embodied and broadly described herein, a hydraulic control valve having a holding valve with improved response characteristics includes a valve housing including a pump path communicating with a hydraulic pump, a tank path communicating with an oil tank, and first and second cylinder ports communicating with a hydraulic cylinder, a control spool movably provided in the valve housing, cutting the pump path off the first and second cylinder ports in a neutral state and selectively connecting the pump path and the tank path with the first and second cylinder ports while moving in left and right directions if pilot signal pressures are applied thereto, a holding valve provided between the second cylinder port and the control spool, cutting off the second cylinder port when the control spool is in a neutral state and holding load of the hydraulic cylinder so as not to cause natural drop of the hydraulic cylinder, and an actuating path for the holding valve connecting hydraulic oil of the second cylinder port to the tank path when the control spool is in a neutral state.

Preferably, the actuating path is of either a notch or hole formed with a predetermined length and width on the surface of the control spool.

Preferably, the actuating path is of a drain hole formed to pass the second cylinder port and the tank path.

Preferably, the actuating path is formed by a separate side valve provided between the second cylinder port and the control spool.

BRIEF DESCRIPTION OF THE DRAWINGS

The above aspects and features of the present invention will be more apparent by describing certain embodiments of the present invention with reference to the accompanying drawings, in which.

DETAILED DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 1:
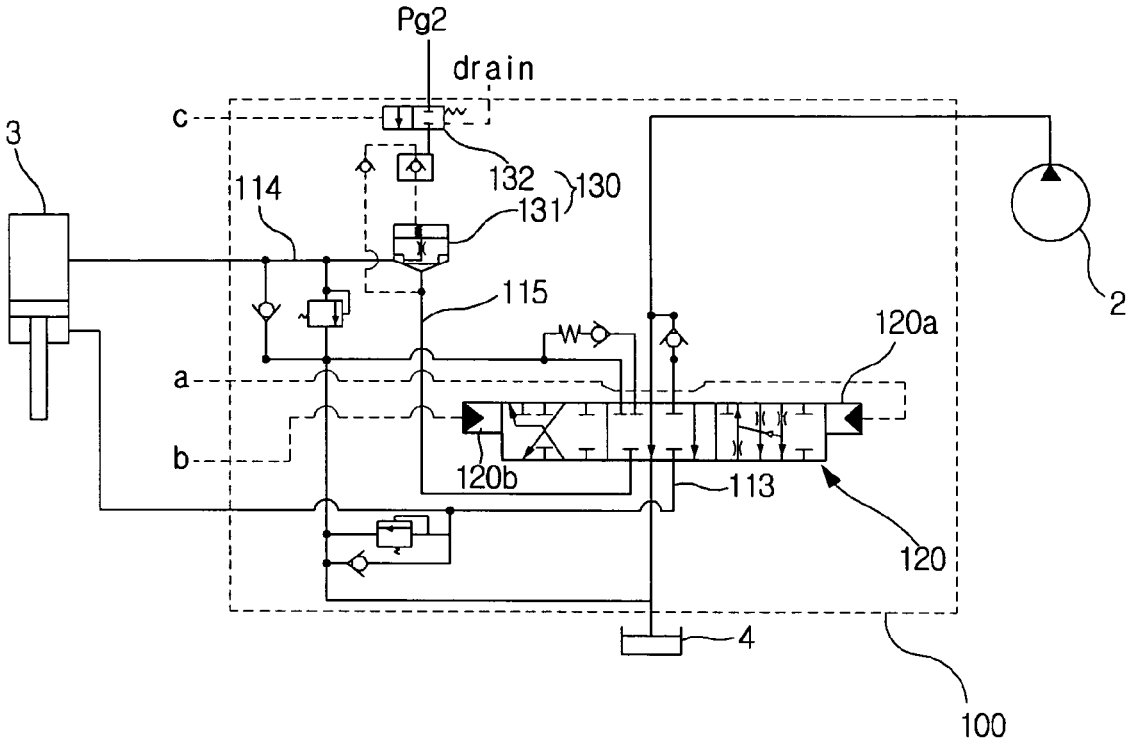
Fig. 1 Prior Art
FIG. 1 is a circuit diagram illustrating a related art hydraulic control valve.
Figure 2:
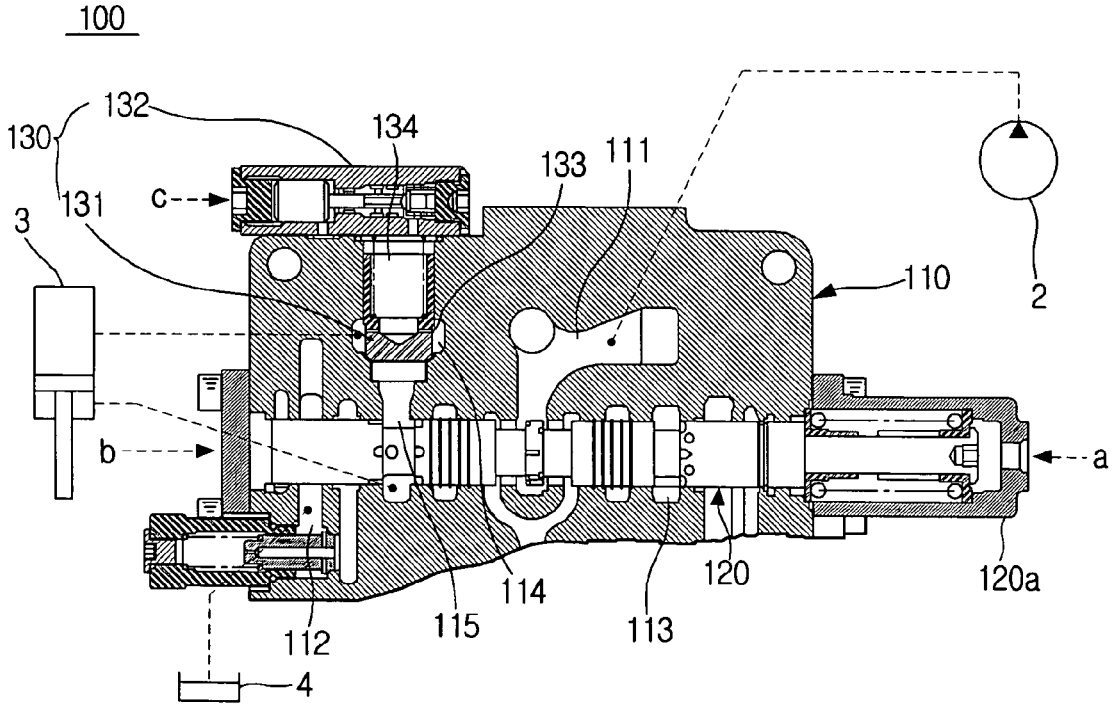
Fig. 2 Prior Art
FIG. 2 is a partially sectional view illustrating a related art hydraulic control valve.
Figure 3:
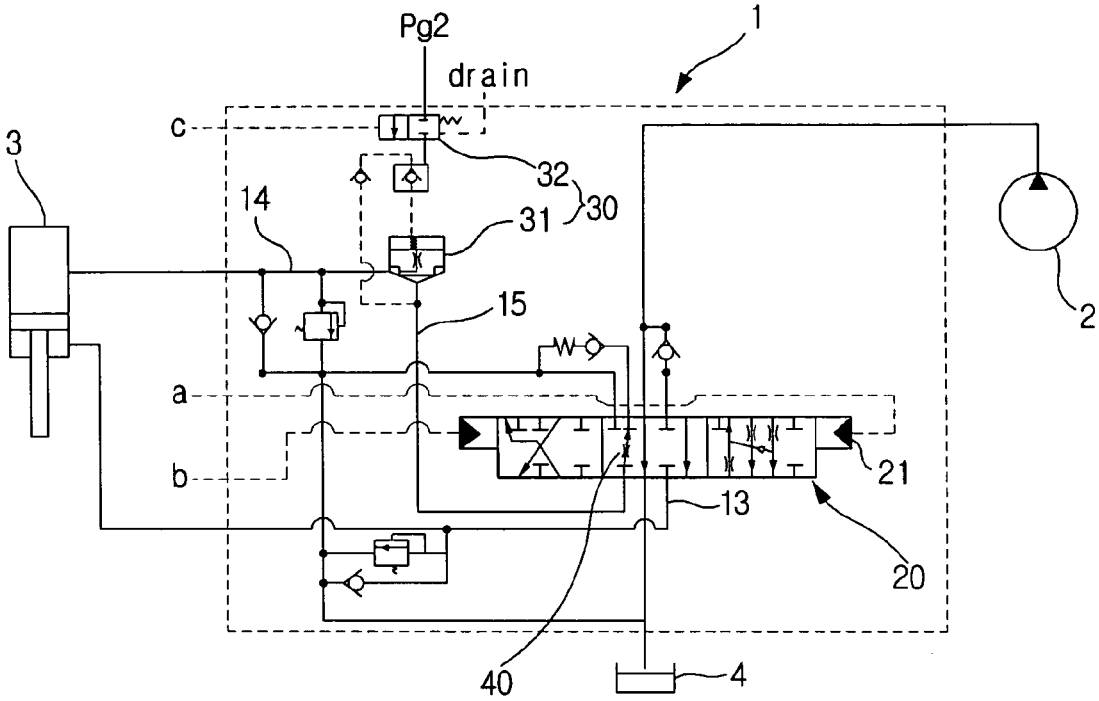
FIG. 3 is a circuit diagram illustrating a hydraulic control valve having a holding valve with improved response characteristics according to the present invention.
Figure 4:
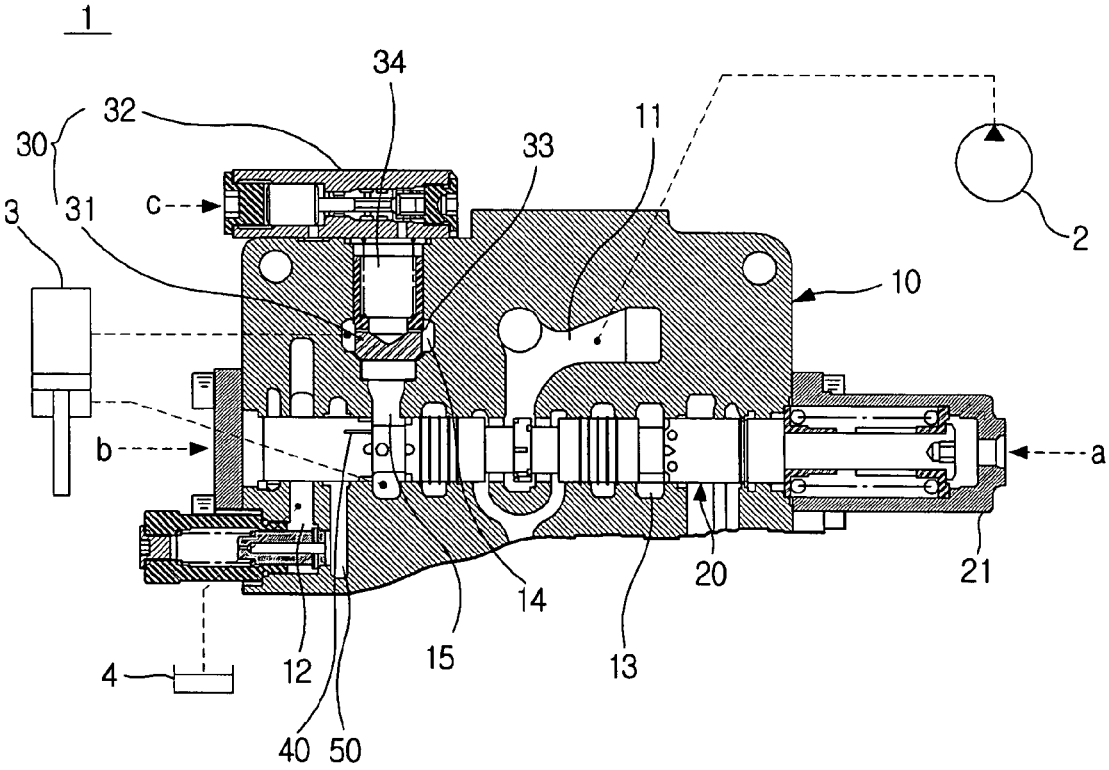
FIG. 4 is a partially sectional view illustrating a hydraulic control valve having a holding valve with improved response characteristics according to the present invention.

FIG. 3 is a circuit diagram illustrating a hydraulic control valve having a holding valve with improved response characteristics according to the present invention, and FIG. 4 is a partially sectional view illustrating a hydraulic control valve having a holding valve with improved response characteristics according to the present invention.

A hydraulic control valve 1 according to the present invention includes a valve housing 10, a control spool 20 provided in the valve housing 10, a holding valve 30, and an actuating path 40 for the holding valve.

The valve housing 10 includes a pump path 11, a tank path 12, and first and second cylinder ports 13 and 14. The pump path 11 communicates with a hydraulic pump 2 that ejects hydraulic oil. The tank path 12 communicates with an oil tank 4 that stores the hydraulic oil. The first and second cylinder ports 13 and 14 communicate with a hydraulic cylinder 3.

The control spool 20 is movably provided in the valve housing 10. If pilot signal pressures 'a' and 'b' are input to the control spool 20, the control spool 20 moves to a left or right side against the valve housing 10 so that the pump path 11 and the tank path 12 may selectively be connected with the first and second cylinder ports 13 and 14. If the control spool 20 is in a neutral state as the pilot signal pressures are not input to the control spool 20, the first and second cylinder ports 13 and 14 are cut off from the pump path 11. In this case, since the hydraulic oil is not supplied to the cylinder ports, the hydraulic cylinder 3 is in an idle state.

As described above, the control spool 20 supplies or cuts the hydraulic oil supplied from the hydraulic pump 2 to or off the hydraulic cylinder 3. Alternatively, the control spool 20 collects the hydraulic oil of the hydraulic cylinder 3 to eject the same to the oil tank 4. Thus, the control spool 20 serves to control driving, stop, and switch of the hydraulic cylinder 3.

The holding valve 30 includes a holding poppet 31 provided on the second cylinder port 14 of the valve housing 10, and a drain valve 32 supplying or cutting the hydraulic oil to or off a rear pressure chamber 34 of the holding poppet 31. In a state that the control spool 20 is neutral, the holding valve 30 holds load of the hydraulic cylinder 3 by cutting off the second cylinder port 14. As a result, natural drop of the hydraulic cylinder 3 does not occur.

The actuating path 40 for the holding valve serves to connect the hydraulic oil of the second cylinder port 14 to the tank path 12 so as to improve response characteristics of the holding valve 30 when the control spool 20 is neutral. Preferably, the actuating path 40 is formed by processing a notch or hole having a predetermined length and width on the surface of the control spool 20. The notch or hole connects the second cylinder port with a reproducing core using the control spool. When the control spool 20 is neutral, the hydraulic oil of the second cylinder port 14 can be ejected to the tank path 12 through the reproducing core. In this case, although not shown, the reproducing core is connected with the tank path by processing a poppet.

Also, although not shown, the actuating path 40 may be formed by processing a drain hole to pass from the second cylinder port to the tank path at a predetermined distance. Alternatively, the actuating path 40 may be formed by processing a separate side valve between the second cylinder port 14 and the control spool 20.

The operation of the aforementioned hydraulic control valve having a holding valve with improved response characteristics will be described as follows.

As shown in FIG. 3 and FIG. 4, when the control spool 40 is neutral as the pilot signal pressures 'a' and 'b' are not input thereto, the first and second cylinder ports 13 and 14 are cut off from the pump path 11. In this case, since the hydraulic oil of the hydraulic pump 2 is not supplied to the hydraulic cylinder 3, the hydraulic cylinder 3 does not work.

The hydraulic oil of the hydraulic cylinder 3 flows into the rear pressure chamber 34 of the holding poppet 31 through the second cylinder port 14 and an orifice 33 of the holding poppet 31. Therefore, the holding poppet 131 is downward pressurized to cut off the second cylinder port 14 so that the hydraulic oil of the hydraulic cylinder 3 may not be ejected to the oil tank 4. As a result, the holding valve 30 holds load of the hydraulic cylinder 3 so as not to cause natural drop of the hydraulic cylinder 3.

If the pilot signal pressure 'a' acts on a pilot port 21 at a right side of the control spool 20, the control spool 20 is switched to the left side so that the pump path 11 may be connected with the first cylinder port 13 and the hydraulic oil of the hydraulic pump 2 may be supplied to the hydraulic cylinder 3 to drive the hydraulic cylinder 3.

When the pilot signal pressure 'a' is applied to the control spool 20, the pilot signal pressure 'c' acts on the drain valve 32 so that the drain valve 32 may be switched to the right side to open the holding poppet 31, thereby ejecting the hydraulic oil of the hydraulic cylinder 3 to the oil tank 4 through the holding poppet 31.

In this state, if the control spool 20 is switched to the neutral state, a connecting line 15 connecting the control spool 20 with the second cylinder port 14 is connected to tank path 12 by the actuating path 40. Therefore, if the control spool 20 is switched to the neutral state, the hydraulic oil of the connecting line 15 is promptly ejected to the oil tank 4. In this case, since the pressure of the connecting line 15 becomes smaller than that of the second cylinder port 14, the holding poppet 31 of the holding valve 30 downward moves to hold load of the hydraulic cylinder 3.

In other words, the holding poppet 31 is driven without time delay by action of the actuating valve 40 so that the holding valve 30 may hold load of the hydraulic cylinder 3. Thus, since response characteristics of the holding valve 30 can remarkably be improved, excessive natural drop of the hydraulic cylinder 3 due to time delay does not occur.

As described above, the hydraulic control valve having a holding valve with improved response characteristics has the following advantage.

Since response characteristics of the holding valve are improved by the actuating path for the holding valve, natural drop of the hydraulic cylinder is reduced, thereby improving stability and reliability of the hydraulic control valve.

The foregoing embodiment and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A hydraulic control valve comprising:

a valve housing including a pump path communicating with a hydraulic pump, a tank path (12) communicating with an oil tank, first and second cylinder ports communicating with a hydraulic cylinder, and a connecting line (15) selectively connected the tank path and the second cylinder port;

a control spool movably provided in the valve housing, cutting the pump path off from the first and second cylinder ports in a neutral state and selectively connecting the pump path and the tank path with the first and second cylinder ports while moving in left and right directions if pilot signal pressures are applied thereto;

a holding valve (30) between the second cylinder port and the control spool, including a holding poppet (31) on the second cylinder port connected with the connecting line and a drain valve (32) supplying hydraulic oil to or cutting the hydraulic oil off from a rear pressure chamber (34) of the holding poppet (31), and cutting off the second cylinder port when the control spool is in the neutral state and holding load of the hydraulic cylinder so as not to cause natural drop of the hydraulic cylinder; and an actuating path (40) in the control spool and connecting the connecting line to the tank path when the control spool is switched to the neutral state.

2. The hydraulic control valve according to claim 1, wherein the actuating path is of either a notch or hole with a predetermined length and width on a surface of the control spool.

* * * * *